United States Patent [19]

Fernandez

[11] Patent Number: 4,747,470

[45] Date of Patent: May 31, 1988

[54] CONCRETE FINISHERS' KNEE SKIS

[76] Inventor: Antonio O. Fernandez, 4334 Cortez Ct., Union City, Calif. 94587

[21] Appl. No.: 60,834

[22] Filed: Jun. 12, 1987

[51] Int. Cl.[4] ..... A47C 7/50; A47C 16/04

[52] U.S. Cl. ..... 182/230; 2/24

[58] Field of Search ..... 182/230; 36/113, 116, 36/122; 2/24

[56] References Cited

U.S. PATENT DOCUMENTS

| | | | |
|---|---|---|---|
| 2,448,427 | 8/1948 | Gordon | 182/230 |
| 2,719,576 | 10/1955 | Emmett | 182/230 |
| 3,726,028 | 4/1973 | Stokes | 182/230 |
| 3,965,586 | 6/1976 | Roosli | 36/122 |
| 4,004,355 | 1/1977 | Koblick | 36/122 |
| 4,043,424 | 8/1977 | Crain | 182/230 |
| 4,346,784 | 8/1982 | Hammond | 182/230 |
| 4,491,193 | 1/1985 | Moss | 182/230 |

*Primary Examiner*—Reinaldo P. Machado
*Attorney, Agent, or Firm*—Linval B. Castle

[57] ABSTRACT

Concrete finishers' knee skis provide a support for a cement finisher to move across wet cement, either kneeling or standing on the skis. Each ski is formed of a elongated sheet stainless steel body with upturned ends and with side walls, both bent with a curvature radius of about ½ inch. In one upturned end is a stirrup cage having a top opening to receive the shoe toe or a worker in a kneeling position, and a second side opening to receive the toe of the worker in a standing position. The ski is thus pulled and pushed only by the shoe toe, and may be moved forward, backward, or sideways without indenting or otherwise damaging the surface of the finished cement.

5 Claims, 2 Drawing Sheets

CONCRETE FINISHERS' KNEE SKIS

BRIEF SUMMARY OF THE INVENTION

This invention relates to concrete finishers' supporting apparatus and particularly to a novel knee support ski-like apparatus that permits sliding movement from either a kneeling or standing position without damaging the surface of the damp concrete.

To obtain a partially finished smooth surface to concrete cement, it is generally necessary to hand trowel the damp surface. When a large area has been poured, the concrete finisher must move out onto the surface and hand trowel while in a kneeling position. To prevent damage to the cement surface, the finisher either kneels on a board that extends across the surface of the concrete or propels himself by a support apparatus such as shown in U.S. Pat. No. 4,346,748 to Hammond.

The knee skis to be described herein provide a means for a cement finisher to either crawl on his knees across a wet concrete surface or to stand and walk or ski across the surface. No size adjustments are necessary and one size will fit all users. Further, the skis are formed so that they may slide forward, backward, or sideways without indenting the surface and thus ruining the smoothed finish of the concrete.

Briefly described, each ski in an identical pair of skis is formed of stainless steel having a smooth flat bottom surface, angled up forward and rear ends, and low side walls bent on about a ½ inch radius from the bottom surface prevents the formation of ridges of indentations in the set cement as the ski is moved. A heavy wire stirrup cage is welded near one inner end to accomodate the toe of the cement worker while kneeling and also when he is standing while facing the opposite direction. The ski is thus moved forward and backward by the worker's toe in the stirrup and his knee contacts only the top surface of the flat portion of the ski while in a kneeling position. A cross shield near the opposite end of the ski and well forward of the worker's knee serves as a handle to help in guiding the ski and also isolates a small part of the ski surface for placing small tools or the like.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
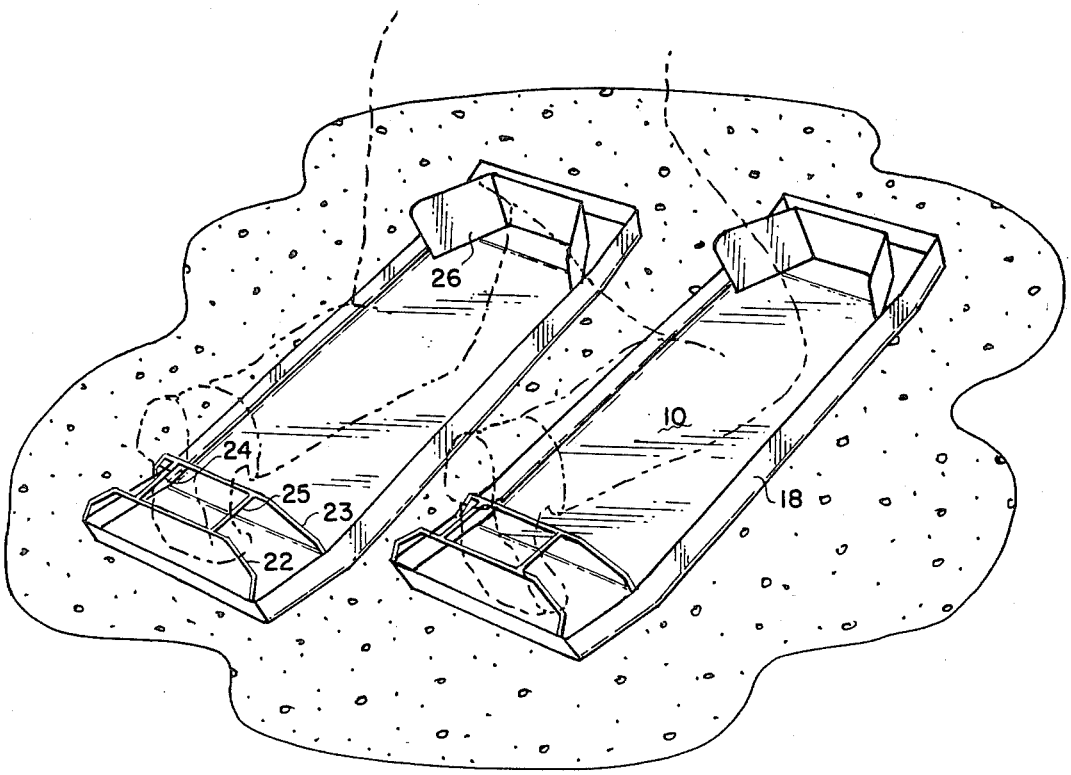
FIG. 1 is a perspective view illustrating a pair of knee skis in use by a worker shown by broken lines.
Figure 2:
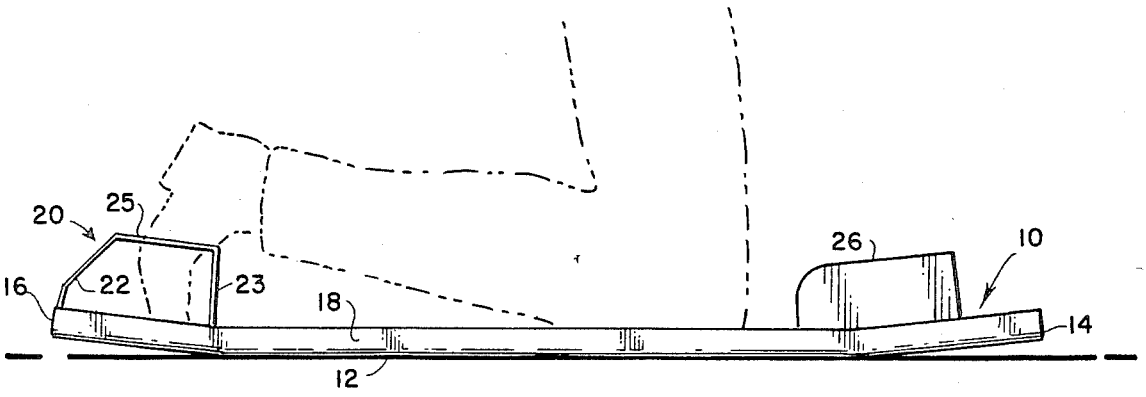
FIG. 2 is a side elevational view of a knee ski and illustrates the approximate position of a workers foot and knee by broken lines.

The concrete finishers' knee skis are used in pairs as shown in the perspective view of FIG. 1. Each ski is identical with the other ski in the pair. A ski 10 is preferably formed from 18 gage stainless steel and, as shown in FIG. 2, is formed with a long flat central body portion 12 approximately twenty inches in length. The approximate width of a ski is eight inches and at each end of the flat central body portion 12 is an upturned first end 14 and second end 16, each end being a straight section about four in length that is bent up at an angle of approximately 10° with a bending radius of about a half inch from the flat central body portion 12. Vertical side and end walls 18 having a preferable height of one inch are similarly bent with about a half inch radius from the floors of the central body portion 12 and the ends 14 and 16, as shown in the end view of FIG. 4.

Welded into the second end 16 of each ski is a stirrup cage 20 preferably formed of 3/16 inch diameter stainless steel rod material. As best shown in FIG. 1, each stirrup cage 20 includes two inverted "U" shaped frames 22, 23 having a substantially flat top surface about 3½ inches above the floor of the ski. The frames are spaced about three inches apart at the top where they are interconnected by parallel cross members 24, 25 that are spaced about five inches apart. Thus, a top plan view of a stirrup cage 20 wil reveal a three by five inch rectangular opening substantially parallel with the ski floor. A concrete finisher's shoe toe is placed into this rectangular opening so that he may, by use of his toe, pull the ski along while his knee rests on the floor of the flat central body portion 12 of the ski.

Figure 3:
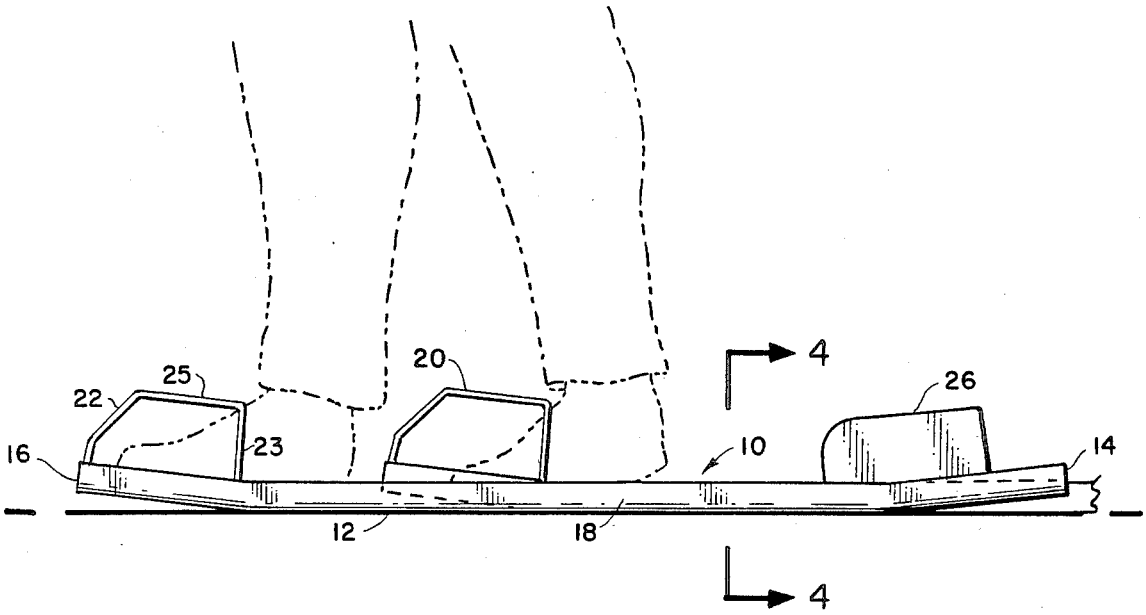
FIG. 3 is a side elevational view of a pair of knee skis and illustrating their use by a worker in a standing position.

If desired, a concrete worker may stand with a foot on the flat central body portion 12 of a ski and with the toe of his shoe within the inverted "U" frame 23 as shown in FIG. 3. When thus standing, the worker is facing toward the second end of the ski and can rather quickly walk or glide across a wet concrete surface.

Located near the first end 14 of the ski is a shield member 26 which spans the width of a ski and which is welded to the inner side walls 12 and the floor of the first end 14. The shield member is separated by about two inches from the extreme first end wall and serves as a splash guard, a fence for holding small tools between it and the end wall, and as a handhold when the concrete worker desires to turn the ski toward a different direction. The shield member 26 does not provide a knee brace for the worker; the member is sufficiently forward and out of reach of the worker's knee which rests only on the floor of the flat central body portion 12 of the ski.

Figure 4:
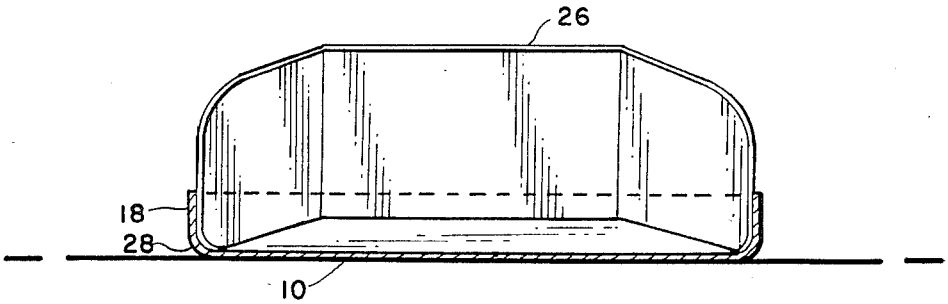
FIG. 4 is an end elevational view of a ski taken along the lines 4—4 of FIG. 3.

FIG. 4 is a sectional end view of a ski through the lines 4—4 of FIG. 3 and illustrates the shield member 26 in the ski 10 and specifically the "soft" or curved chine 28 with an approximate ½ inch radius of curvature between ski floor and wall 18. Because the bottom surface of the stainless steel ski 10 is very smooth and because breaks between the bottom surface and ends 14 and 16, and walls 18 have such curvature, a cement worker with his weight placed on the floor of the flat central body portion 12 can move over wet cement, either forward, backward, or sideways, without causing ski indentations in the cement surface as is common with conventional knee supporting boards.

I claim:

1. Float apparatus for supporting cement finishers, said apparatus comprising:

an elongated rectangular body having a top surface, a smooth bottom surface, and upturned first and second end sections;

side walls on said body, the intersection of said side walls and said bottom surface having a radius of curvature of at least three-eights of an inch, and a stirrup cage attached to the upturned second end of said body, said cage comprising longitudinally spaced first and second inverted U-shaped frames laterally attached to the top surface of said body and having interconnecting cross members to form a first opening substantially parallel with and spaced from said top surface for receiving a shoe toe of a cement finisher kneeling on said rectangular body and a second opening substantially perpendicular to said top surface and through one said inverted U-shaped frames to form a second opening for receiving the shoe toe of the cement finisher standing on said rectangular body.

2. The apparatus claimed in claim 1 wherein said rectangular body includes a flat central body portion and wherein said first and second upturned end sections are angled approximately 10° up from the bottom surface of said body portion.

3. The apparatus claimed in claim 2 wherein said flat central body portion, said end sections, and said side walls for formed from stainless steel sheet material.

4. The apparatus claimed in claim 2 further including a vertical shield attached to the top surface floor of said first end for providing a handhold to aid in turning said body.

5. The support apparatus claimed in claim 2 wherein said apparatus is one unit of a pair of identical units for supporting a cement finisher for moving across wet cement in kneeling and standing positions.

* * * * *